United States Patent [19]

Morse

[11] 4,429,787

[45] Feb. 7, 1984

[54] COIN CARD AND INTEGRAL INFORMATION CHART THEREFOR

[76] Inventor: H. Clifton Morse, 345 Fullerton Pkwy., Chicago, Ill. 60614

[21] Appl. No.: 414,827

[22] Filed: Sep. 3, 1982

[51] Int. Cl.[3] ..... A45C 11/28

[52] U.S. Cl. ..... 206/83; 206/0.84; 206/485; 229/72; 229/75

[58] Field of Search ..... 206/0.83, 0.84, 311, 206/425, 445, 485, 486, 495; 180/52 B; 229/72, 68 R, 75

[56] References Cited

U.S. PATENT DOCUMENTS

| | | | |
|---|---|---|---|
| 2,459,292 | 1/1949 | Sherbondy | 206/0.84 |
| 2,775,392 | 12/1956 | Frankenstein | 229/38 |
| 3,214,075 | 10/1965 | Champlin et al. | 229/16 |
| 3,217,866 | 11/1965 | Phelps | 206/0.83 |
| 3,219,253 | 11/1965 | Davis | 229/16 |
| 3,302,861 | 2/1967 | Hiersteiner | 229/70 |
| 3,467,299 | 9/1969 | Meyer | 229/70 |
| 3,902,656 | 9/1975 | Rothchild | 229/75 |
| 3,913,732 | 10/1975 | Peterson | 206/0.84 |
| 4,031,850 | 6/1977 | Gantt | 116/135 |
| 4,058,916 | 11/1977 | Whyatt | 206/0.84 |
| 4,093,117 | 6/1978 | Morse | 229/70 |

*Primary Examiner*—Joseph Man-Fu Moy
*Attorney, Agent, or Firm*—Gerald S. Geren

[57] ABSTRACT

Coin card and integral slide chart therefor, giving information of numismatic value regarding the coins in the coin card, and made from a single piece of cardboard by automatic slitting, gluing and folding operations.

9 Claims, 5 Drawing Figures

COIN CARD AND INTEGRAL INFORMATION CHART THEREFOR

BACKGROUND OF THE INVENTION

My prior U.S. Pat. No. 4,093,117 and the references cited in the file of the application which matured into this patent, show forms of mailing envelopes, but the envelopes can only be used as mailing envelopes, but do not show a coin card and computer in the form of a slide and slide card made from one piece of cardboard in which the slide card gives information of numismatic value or other information regarding the coins or other articles carried by the coin card.

My prior application Ser. No. 368,469 filed Apr. 14, 1982 shows a one-piece carton and billboard type of slide chart in which the slide chart may suspend the carton on a display board for sales purposes, with no suggestion of coin cards and the cooperation of a slide chart type of computer with the coins in the coin slots of coin cards, in which the coin cards and computer type of slide card are coordinated to give valuable information concerning the coins in the coin slots.

SUMMARY AND ADVANTAGES OF INVENTION

The coin card and slide chart of the present invention improves upon the prior art in that it may be formed from a single piece of cardboard hinged about hinge lines and glued to form a pair of hinged coin cards and a cooperating computer type of slide chart hinged to an adjacent coin card may give valuable information concerning the coins in the slots of the coin cards, and may be adhesively secured to form by an automatic gluing operation. The slide chart or computer forming a continuation of the coin cards may be calibrated to designate the coins in each row of coin receptacles in the coin cards, and give valuable information about the coins in the coin slots of the coin cards, necessary for coin collectors. As for example, the slide chart may give the date the coins were first minted, the number of coins minted and the value of the coins in accordance with the mint in which the coins were minted, whether the coins are still in circulation or other information essential for coin collectors.

For convenience, cards for different denominations of coins may be made with the slide chart forming a continuation thereof, or one coin card may be for coins of one denomination and the next adjacent coin card hinged thereto may be for coins of another denomination. Windows for each card may be provided either in one row as shown in FIG. 1 or in two or more rows. Tokens may also be substituted for coins and the slide chart may give information relevant to the tokens.

An advantage of the invention is that a plurality of hinged coin cards may have a slide chart associated therewith to give information regarding the coins in the coin cards, and the coin cards and slide chart may all be formed from a single piece of cardboard automatically glued and formed by machine.

A further advantage of the invention is that a series of coin cards may be made from a single piece of stiff cardboard, machine folded and glued with the coin cards folded over each other, and a slide chart may be positioned to one side of the coin cards, and formed by folding a precut portion of the same piece of cardboard over another area of the piece of cardboard of substantially the same size, and the slide and slide card may give valuable information regarding the coins in the coin slots of the coin cards.

A still further advantage of the invention is the simplicity of the coin card and associated slide chart and its usefulness for coin collectors and other purposes.

An object of the invention is to attain a simplified form of double coin card and slide chart appended thereto from a single piece of stiff cardboard, in which the slide chart may give valuable information relative to the coins in the coin cards, and the coin cards and slide chart may be in line and folded over each other to increase the compactness and utility of the coin cards and related slide chart.

Other objects, features and advantages of the invention will be readily apparent from the following description of a preferred embodiment of the invention, taken in conjunction with the accompanying drawings, it being understood that variations and modifications of the invention may be effected without departing from the spirit and scope of the novel concepts of the disclosure.

DESCRIPTION OF PREFERRED EMBODIMENT

Figure 3:
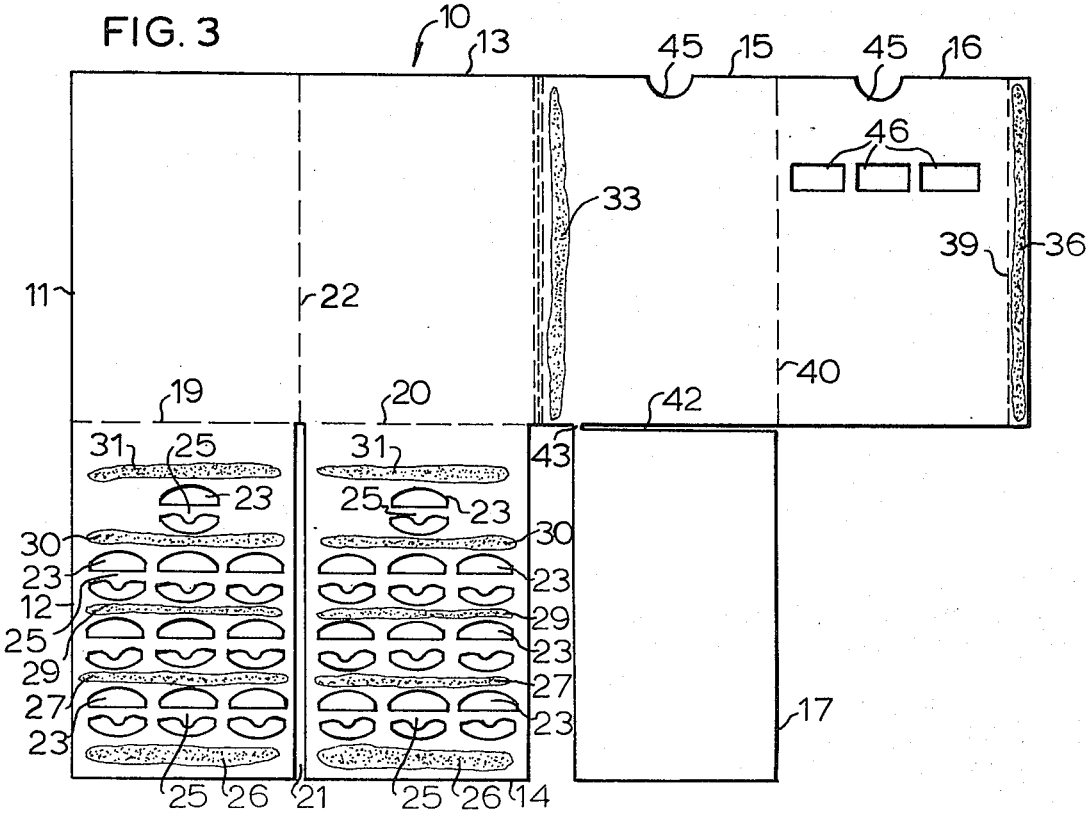
FIG. 3 is a plan view of a sheet of cardboard with one portion formed with coin slots and retainers for retaining the coins to the coin cards, showing the fold lines by dashed lines and diagrammatically showing the adhesive strips with the slide card for the slide retained to the cardboard by a retainer tab, to be removed by breaking the tab to accommodate placing of the slide card in the slide for movement therealong.

In FIG. 3 of the drawings, I have shown a flat, stiff cardboard sheet 10 divided into seven sections 11, 12, 13, 14, 15, 16 and 17, the sections 12, 14 and 17 forming continuations of the respective sections 11, 13 and 15.

The sections 11 and 12 are separated by a fold line 19. The sections 13 and 14 are separated by a fold line 20. The sections 12 and 14 are spaced apart by a gap 21 separating said sections and accommodating the sections 12 and 14 to be folded over the sections 11 and 13 about the respective fold lines 19 and 20.

Figure 1:
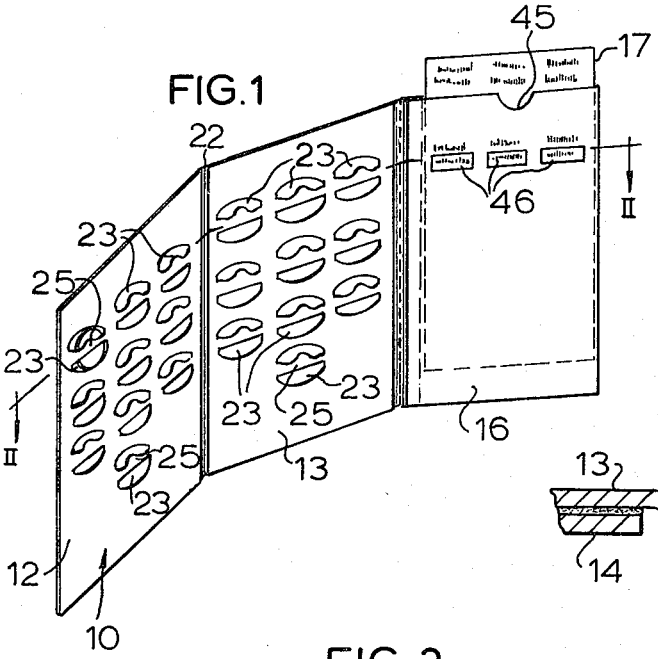
FIG. 1 is a perspective view of the coin cards and slide chart, with the coin cards in an open position and the slide card partially pulled along its slide, to designate valuable information regarding the coins in the coin cards.
Figure 2:
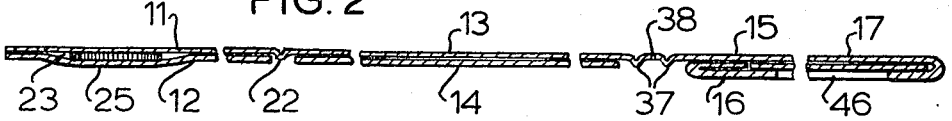
FIG. 2 is a sectional view taken substantially along line II—II of FIG. 1 showing a coin in a coin slot and the coin cards and slide chart extending in substantially the same plane.

The sections 12 and 14 have rows of coin slots 23 spaced therealong with an inner end coin slot 23 in alignment with the center coin slots 23 of each row of coin slots and spaced from, but closer to the fold line 19 than the rows of coin slots 23. The coin slots 23 are of a conventional construction with rounded edges generally fitting a coin of conventional form and of a preselected denomination. Retainer straps 25 extend across said coin slots and are shown in FIGS. 1 and 2 as retaining a coin in a slot.

As shown in FIG. 3, an adhesive strip 26 extends along, but is spaced inwardly of the outermost edges of the respective sections 12 and 14 while adhesive strips 27, 29, and 30 separate each row of coin slots 23 of the respective sections 12 and 14. An adhesive strip 31 extends across the respective sections 12 and 14 and separates the innermost coin slots 23 from the fold lines 19 and 20. The adhesive strips 26, 27, 29, 30 and 31 may be pressure sensitive adhesive strips. The sections 12 and 14 may thus be folded along the respective fold lines 19 and 20 over the respective sections 11 and 13 and adhesively secured thereto by the application of pressure to said sections by machine. The folding of the sections 12 and 14 over the sections 11 and 13 may be by machine and the gluing operation may also be by machine in a manner known to the art. The adhesive strips 26 and 31 may also be a conventional form of pressure sensitive adhesive or glue and may extend close to the end edges of the sections 12 and 14, respectively, to securely glue said sections to the respective sections 11 and 13.

Figure 4:
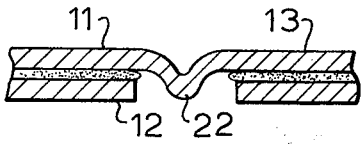
FIG. 4 is an enlarged transverse sectional view illustrating the hinge between the glued coin cards, about which the coin cards may be folded when the cards are to be folded to a compact form.

FIG. 4 shows a fold 22 in alignment with the gap 21 as a relatively deep accordian type of fold line which serves as a hinge to give depth to the hinge and permit folding of the sections 11 and 12 over the sections 13 and 14 when desired.

Figure 5:
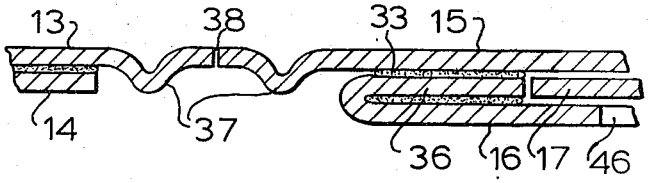
FIG. 5 is a sectional view illustrating a portion of one glued coin card, the fold lines connecting the coin cards to the slide chart and the perforations between the fold lines which may form tear lines where it may be desired to remove the slide chart from the end coin card.

The side of the section 15 adjacent the coin card section 13 has an adhesive strip 33 extending therealong and adapted to adhere to the non-glued side of an inwardly folded glue flap 36 of the section 16, to form a slide for a slide card 17 in alignment with the section 15. The sections 13 and 15, as shown in FIGS. 2 and 5, are joined together by double fold lines 37 of the accordian type, to form hinges, the hinge portions of which are connected together by perforations 38 between the hinges of the accordian type double hinge, to accommodate removal of the slide and slide chart from the coin card as a unit as, for example, where a number of separate computer type slide cards are provided and it may be desired to substitute one for the other to give different information regarding the coins in the coin slots 23.

A fold line 39 is spaced from the outer margin of the end section 16. An adhesive strip extends along the section 16 outside of the fold line 39 on the same side of the section 16 as the adhesive strip 33 on the section 15 to form the glue flap 36. The adhesive strip 36, like the adhesive strips 29, 31 and 33, may be pressure sensitive adhesive strips and the glue flap 36 extending outwardly of the fold line 39 may be folded inwardly about said fold line 39.

A fold line 40 defines the adjacent margins of the sections 15 and 16 to accommodate the section 16 to be folded over the section 15 and the back side of the glue flap 36, to be glued to the adhesive strip 33 by a pressure sensitive adhering operation, to form a slide for the section 17. The section 17 is slit at its juncture with the section 15, as indicated by reference numeral 42 and terminates into a tab 43, which may be broken off when it is desired to use the section 17 as a slide card in the slide defined by the inner faces of the sections 15 and 16 and the end of the glue flap 36.

It should be clear from the foregoing that the sections 11 through 16 may be sheared or otherwise formed from the sheet of stiff cardboard 10 by a punching operation, and the sections 12 and 14 may be folded over the sections 11 and 13 along the fold lines 19 and 20. The glue flap 36 may be folded about the fold line 39 over the section 16 and glued thereto. The section 16 may also be folded along the fold line 40 and the flap 36 may be glued to the adhesive strip 33 by a pressure sensitive adhesive operation.

The section 17 may be broken from the section 15 by severing the tab 43, or the section 15 may be folded inwardly about the slit 42 prior to folding the section 16 over the section 15, where it is desired to positively retain the slide card formed by the section 17 to the slide formed by the sections 15 and 16 until it is desired to use the slide card. The slide card may be released by breaking the tab 43, to perform its computer function and may be moved along the slide formed by the facing sections 15 and 16 by the fingers engaging the slide card through thumb notches 45,45, registering with each other, when the slide is formed by folding the section 16 about the fold line 40 and gluing the glue tab 36 to the face of the section 16, as by a pressure sensitive adhering operation.

The slide card 16 is herein shown as having three aligned windows 46 therein, which may register with indicia on the slide card 17 as the slide card is moved outwardly along the slide to give valuable information regarding the coins in the coin slots 23, such as the date of first minting of the coins, the value of the coins from a numismatic standpoint, the number of coins in circulation, the mint in which the coins of certain dates were minted and other information of value to coin collectors.

Any desired indicia on the slide card may be printed on the card prior to forming of the coin cards and slide chart, while any indicia relative to the windows 46, may be prepainted on the sheet of cardboard.

It should be understood that the outer edge of the section 16 or glue flap 36 when glued to the section 16 and to the section 15, forms a guide rail for the slide card 17, and that the folded end, folded along the fold line 40 forms a guide for the opposite side of the slide card 17 from the guide edge formed by the inturned end of the glue flap 36, to accommodate ready movement of the slide card to reveal the required indicia and offer sufficient frictional resistance to the slide card to hold the card in position, once it is set to reveal the required indicia.

It should also be understood that the coin slots need not necessarily hold coins, but may hold tokens or similar articles, and the slide chart may designate the value of the tokens or the articles in the coin slots and the use to which they may be put. This is particularly valuable where the tokens or simulated coins may be redeemable in cash or merchandise as the coin slots become filled, or as a designated number of tokens are placed in the coin slots, it being understood that the tokens may be obtained by the purchase of merchandise and may be redeemable as a means for giving a discount on the merchandise originally purchased, as determined by the tokens in the coin slots, and the slide chart cooperating therewith.

I claim as my invention:

1. An article retaining card and cooperating slide chart formed from a single piece of relatively stiff flat cardboard cut to have parallel end edges, one generally continuous side edge and an opposite interrupted side edge including two side by side disconnected article retaining cards having article carrying slots therein and foldable over said piece of cardboard to define two connected article retaining cards of substantially the same area, an accordian fold line extending along said piece of cardboard defining the backs of said article retaining cards, said piece of cardboard also including a slide card formed integrally therewith and removable therefrom, and a double-accordian type fold line defining an expandable hinge extending along said single piece of cardboard at the margin of the innermost of said article retaining cards, the balance of said strip of cardboard beyond said article retaining cards comprising two aligned generally rectangular pieces of cardboard of substantially equal size and a hinge line intermediate the ends of said pieces of cardboard accommodating said pieces of cardboard to be folded over each other, an outer end of said two aligned pieces of cardboard including an adhesive spacer flap foldable over said end, an adhesive strip extending along one side of said flap, another adhesive strip extending along one of said pieces adjacent said expandable hinge for adhesively securing said spacer flap to said piece of cardboard to space said pieces apart to form a slide for said slide card, said slide card having indicia thereon pertinent to the articles insertible in said slots, and the outer face of said slide having windows therein enabling the viewing of said indicia on said slide card upon movement of said slide card along said slide.

2. The article retaining card and cooperating slide chart of claim 1 including adhesive strips extending between said article carrying slots extending across said article retaining cards and beyond the end slots, to accommodate automatic gluing of said article retaining cards, by folding said cards over said single piece of cardboard on opposite sides of said fold line and exerting pressure thereon.

3. The article retaining card and cooperating slide chart of claim 2 including a hinge line connecting said assembled article retaining cards together to accommodate folding of said article retaining cards about their inner ends and filled with articles, in which the accordian type of hinge line is relatively deep to compensate for the double thickness of said cards and accommodate folding of said article retaining cards over each other and then filled with articles such as coins and the like.

4. The article retaining card and slide chart of claim 2 in which the articles are coins and an in-turned flap glued on each side when said slide is assembled spaces said two pieces of said single piece of cardboard apart to form a slide for said slide card to receive said slide card therebetween and the end of said in-turned flap forms a guide rail for said slide, and in which indicia on said slide card, pertain to the articles in said article retaining card, and windows in said slide accommodate viewing of said indicia.

5. A coin card and cooperating slide chart made from a single piece of relatively stiff flat cardboard having parallel end edges, one generally continuous side edge and an opposite parallel interrupted side edge, the portions of said card extending inwardly of said interrupted side edge terminating into fold lines parallel to said continuous side edge, the portion of said piece of cardboard to one side of said fold line defining the backs of two coin cards and the portion of said card extending to the opposite side of said fold line having coin slots therein forming receptacles for coins of preselected denominations, a gap separating said portions of said card having coin slots therein, an accordian type fold line in alignment with said gap and extending along said backs, pressure sensitive adhesive means securing the slotted portions of said piece of cardboard to said backs to enable the retention of coins in said coin slots, said accordian type of fold line accommodating one coin card and back to be folded over the other, parallel spaced fold lines defining a double accordian type hinge at the end of the innermost of said backs for said coin coin cards, and the portion of said card extending beyond said double accordian type hinge being foldable to define a slide having windows therein, said interrupted side edge including a slide card having indicia thereon, a breakable tab retaining said slide to said interrupted side edge, a fold line dividing said piece of cardboard beyond said double type accordian hinge and accommodating one portion of the card to be folded over the other, and the outermost end of said plain surfaced card having a spacer flap having adhesive applied thereto, foldable inwardly over said piece of cardboard, and adapted to form a spacer, spacing the portions of said card on the opposite sides of said fold line apart a distance sufficient to accommodate the insertion of said slide card therebetween and the movement of said slide card along said slide.

6. The coin card and cooperating slide chart of claim 5 in which said spacer flap has a pressure sensitive adhesive strip extending therealong, accommodating folding of said spacer over the adjacent side of said slide, and in which adhesive extends along said piece of cardboard adjacent but outwardly of said double accordian type fold line, to accommodate one portion to be folded over the other and to enable said spacer flap to space the portions of said slide apart and to retain said folded portions in spaced relation with respect to each other.

7. The coin card and computer of claim 6 in which adhesive strips extend across said coin cards in the spaces between and outside of said coin slots and form a means for adhering the slotted portions of said coin cards to the plain surfaced backs thereof by a pressure adhesive adhering operation.

8. The coin card and slide chart of claim 7 wherein the slide card has indicia thereon giving pertinent information regarding the coins in said coin slots, and wherein windows are provided in the face of said slide facing in the direction of said coin slots, to enable the indicia on said slide to be viewed upon sliding movement of said slide card to obtain pertinent information relative to the coins in said coin slots.

9. The coin card and slide chart of claim 8 in which the folding and adhesively securing operations are automatic folding and gluing operations.

* * * * *